US005810280A

United States Patent [19]

Ryan et al.

[11] Patent Number: 5,810,280

[45] Date of Patent: Sep. 22, 1998

[54] MATRIX REWINDER

[75] Inventors: Ralph L. Ryan, East Hanover; Edward J. Caprario, Elizabeth, both of N.J.

[73] Assignee: Compensating Tension Controls, Inc., West Caldwell, N.J.

[21] Appl. No.: 883,248

[22] Filed: Jun. 26, 1997

[51] Int. Cl.[6] ..... B65H 19/26; B65H 19/28; B65H 19/30

[52] U.S. Cl. ..... 242/521; 242/523.1; 242/527.3; 242/532.3; 242/533.6

[58] Field of Search ..... 242/521, 523, 242/523.1, 527.3, 532.3, 533.6

[56] References Cited

U.S. PATENT DOCUMENTS

| | | | |
|---|---|---|---|
| 1,819,406 | 8/1931 | Cannard et al. . | |
| 1,967,648 | 7/1934 | Wood . | |
| 2,357,976 | 9/1944 | Roesen . | |
| 2,361,264 | 10/1944 | Christman . | |
| 2,585,227 | 2/1952 | Christman . | |
| 2,728,532 | 12/1955 | Bower et al. . | |
| 3,421,709 | 1/1969 | Breacker et al. . | |
| 3,599,888 | 8/1971 | Coudriet et al. . | |
| 3,733,035 | 5/1973 | Schott | 242/533.6 |
| 3,743,206 | 7/1973 | Riegger . | |
| 3,794,256 | 2/1974 | Schwarz | 242/533.6 |
| 3,848,823 | 11/1974 | Mitchell | 242/533.6 |
| 4,266,735 | 5/1981 | Leanna et al. . | |
| 4,488,687 | 12/1984 | Andreasson | 242/527.3 |
| 5,215,276 | 6/1993 | Aoki et al. . | |
| 5,221,056 | 6/1993 | Walliser et al. . | |

FOREIGN PATENT DOCUMENTS

| | | | |
|---|---|---|---|
| 57-72545 | 5/1982 | Japan | 242/533.6 |

*Primary Examiner*—John M. Jillions
*Attorney, Agent, or Firm*—Richard M. Goldberg

[57] ABSTRACT

A matrix rewinder includes a spider assembly having a spider drive shaft, a central hub thereon, a plurality of angularly spaced guide rods extending radially outward from the hub, a mounting block slidably mounted on each guide rod pair for radial movement, a mandrel rotatably mounted to each mounting block, and a drive motor for rotating the spider drive shaft; a mandrel drive shaft mounted coaxially with the spider drive shaft; a mandrel drive motor for rotating the mandrel drive shaft independently of the spider drive shaft to drivingly engage a first core removably mounted on the first mandrel at a first position to wind a web matrix on the first core; a cam track for guiding a second core removably mounted on a second mandrel into driving engagement with the mandrel drive shaft; a sensor sensing a diameter of the web matrix on the first core at the first position, and controlling the spider drive motor to move the second core into engagement with the web matrix when the web matrix wound on the first core at the first position has reached a predetermined diameter; and a knife assembly for cutting the web matrix extending between the first and second cores when the spider drive shaft moves the second core on the second mandrel into engagement with the web matrix such that the web matrix is then wound on the second core which has been then moved to the first position.

23 Claims, 5 Drawing Sheets

MATRIX REWINDER

BACKGROUND OF THE INVENTION

The present invention relates generally to a web winding apparatus, and more particularly, is directed to a matrix rewinder for rewinding a skeletal matrix web.

In many instances, a silicone layer has a paper or plastic top layer adhesively mounted thereon. The top layer is printed with labels, and the top layer is die cut around the labels. Then, the silicone layer with labels thereon is wound on a roll. However, the portion of the top layer between the labels is removed, and therefore has a plurality of openings therein, and is called a skeleton or matrix, the latter term being used herein.

The matrix is wound onto a disposal or rewind core mounted on a mandrel. When the rewind roll (core plus matrix) acquires a predetermined diameter of matrix thereon, it must be removed, and a new rewind core mounted on the mandrel. However, this requires shutting down the machine, resulting in downtime. This becomes cumbersome in practice, and costly.

OBJECTS AND SUMMARY OF THE INVENTION

Accordingly, it is an object of the present invention to provide a matrix rewinder that overcomes the problems with the aforementioned prior art.

It is another object of the present invention to provide a matrix rewinder in which a new rewind core is automatically positioned to receive the web matrix for winding after the web matrix wound on a full rewind roll reaches a predetermined diameter.

It is still another object of the present invention to provide a matrix rewinder that does not require stopping the machine in order to change a full rewind roll.

In accordance with an aspect of the present invention, a matrix rewinder comprises a spider assembly including a spider drive shaft having an axis, a plurality of guides fixed with respect to the spider drive shaft and extending radially outward from the spider drive shaft, the guides being angularly spaced from each other around the spider drive shaft, a mounting block mounted on each guide for radial movement therealong, a mandrel rotatably mounted to each mounting block, for holding a core for receiving a web matrix having an adhesive coating thereon, and a spider drive motor for rotating the spider drive shaft so as to rotate the mandrels about the axis of the spider drive shaft. The matrix rewinder further comprises a mandrel drive shaft mounted coaxially with the spider drive shaft and rotatable independently of the spider drive shaft. A mandrel drive motor rotates the mandrel drive shaft independently of the spider drive shaft such that a first core removably mounted on a first mandrel in driving engagement with the mandrel drive shaft at a first position is rotated by the mandrel drive shaft so as to wind the web matrix on the first core, with the adhesive coating fixing the web matrix to the first core. A guide assembly guides a second core removably mounted on a second mandrel into driving engagement with the mandrel drive shaft such that the mandrel drive shaft rotates the second core in driving engagement therewith, while the first core is driven by the mandrel drive shaft and while the second core is out of engagement with the web matrix. A sensor senses a diameter of the web matrix on the first core at the first position, and supplies a signal to the spider drive motor to rotate the spider drive shaft so as to move the second core on the second mandrel into engagement with the web matrix and then to the first position in response to the sensor sensing that the web matrix wound on the first core on the first mandrel at the first position has reached a predetermined diameter, such that the web matrix extending between the first and second cores is broken and the web matrix is then wound on the second core on the second mandrel at the first position.

The spider assembly includes a central hub mounted on the spider drive shaft and the plurality of guides are secured to the central hub so as to extend radially outward of the spider drive shaft. The guides are equiangularly spaced around the spider drive shaft. Each guide preferably includes a pair of parallel, spaced apart guide rods extending radially outward from the central hub. Each mounting block is slidably mounted on the pair of guide rods for radial movement therealong. The spider assembly further includes a stop plate secured to radial outer ends of the guide rods for limiting radial outward movement of the mounting blocks on the guide rods.

The guide assembly includes a cam track; and a cam follower rotatably mounted coaxially with each mandrel and engaging with the cam track during a selected segment of rotation thereof about the spider drive shaft. Preferably, the first position is a top dead center position at 0°, and the selected segment of rotation occurs between approximately 150° and 270° relative to the top dead center position.

Further, the guide assembly includes a spring element which presses the second core on the second mandrel into driven engagement with the mandrel drive shaft at a position immediately before the second core is moved into engagement with the web matrix.

In accordance with another aspect of the present invention, a matrix rewinder comprises a spider assembly including a spider drive shaft having an axis, a plurality of guides fixed with respect to the spider drive shaft and extending radially outward from the spider drive shaft, the guides being angularly spaced from each other around the spider drive shaft, a mounting block mounted on each guide for radial movement therealong, a mandrel rotatably mounted to each mounting block, for holding a core for receiving a web matrix having an adhesive coating thereon, and a spider drive motor for rotating the spider drive shaft so as to rotate the mandrels about the axis of the spider drive shaft. The matrix rewinder further comprises a mandrel drive shaft mounted coaxially with the spider drive shaft and rotatable independently of the spider drive shaft. A mandrel drive motor rotates the mandrel drive shaft independently of the spider drive shaft such that a first core removably mounted on a first mandrel in driving engagement with the mandrel drive shaft at a first position is rotated by the mandrel drive shaft so as to wind the web matrix on the first core, with the adhesive coating fixing the web matrix to the first core. A guide assembly guides a second core removably mounted on a second mandrel into driving engagement with the mandrel drive shaft such that the mandrel drive shaft rotates the second core in driving engagement therewith, while the first core is driven by the mandrel drive shaft and while the second core on the second mandrel is out of engagement with the web matrix. A sensor senses a diameter of the web matrix on the first core at the first position, and supplies a signal to the spider drive motor to rotate the spider drive shaft so as to move the second core on the second mandrel into engagement with the web matrix and then to the first position in response to the sensor sensing that the web matrix wound on the first core on the first mandrel at the first position has reached a predetermined diameter. Then, a knife assembly cuts the web matrix extending between the first and second cores when the spider drive shaft moves the second core on the second mandrel into engagement with the web matrix and then to the first position, such that the web matrix is then wound on the second core on the second mandrel at the first position.

The knife assembly includes a tensioning assembly for tensioning the web matrix extending between the first and second cores; and a knife device for cutting the tensioned web matrix extending between the first and second cores.

The tensioning assembly includes a shaft, a tie bar roll for pressing down the web matrix extending between the first and second cores to tension the web matrix thereat, at least one arm mounted on the shaft for rotation about an axis of the shaft, and having the tie bar roll secured to a free end thereof and a driving assembly for rotating the at least one arm about the axis of the shaft so as to move the tie bar roll between a first position out of engagement with the web matrix and a second position into pressing engagement with the web matrix.

The knife device includes a knife for cutting the web matrix, a shaft, at least one arm mounted on the shaft for rotation about an axis of the shaft, and having the knife secured to a free end thereof, and a driving assembly for rotating the at least one arm about the axis of the shaft so as to move the knife between a first position out of engagement with the web matrix and a second position which cuts the web matrix after the tensioning assembly tensions the web matrix extending between the first and second cores.

The knife assembly further includes a press down member for pressing down the cut web matrix onto the second core on the second mandrel. The press down member is secured to the knife device.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
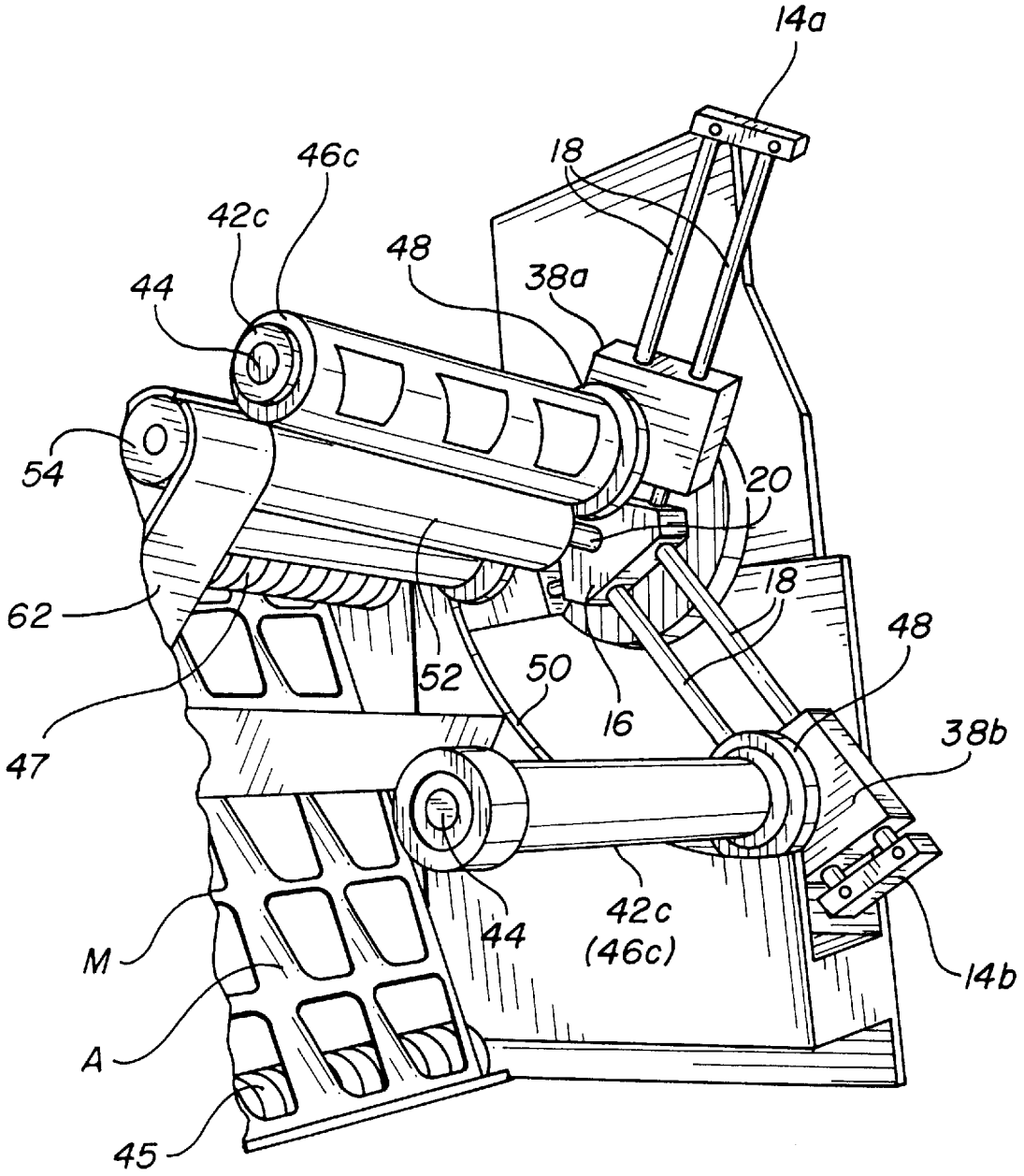
FIG. 1 is a perspective view of a portion of a matrix rewinder according to the present invention.

Referring to the drawings in detail, a spider assembly 10 includes three elongated plates 12*a*, 12*b* and 12*c* secured together in a triangular configuration by three stop plates 14*a*, 14*b* and 14*c* at the apices of the triangular configuration. Plates 12*a*, 12*b* and 12*c* are not shown in FIG. 1 in order to better illustrate the arrangement in FIG. 1. A triangular support hub 16 is positioned centrally of the triangular configuration, and two guide rods 18 are connected in parallel relation between each stop plate 14*a*–14*c* and a respective side of triangular support hub 16.

Triangular support hub 16 is fixed on a spider drive shaft 20 such that rotation of spider drive shaft 20 results in rotation or indexing of spider assembly 10. A drive motor 22 includes an output shaft 24 having a pulley 26 thereon. A pulley 28 is mounted on spider drive shaft 20, and an endless belt 30 is mounted around pulleys 26 and 28 such that rotation of output shaft 24 results in rotation of spider drive shaft 20.

In order to control rotation of spider drive shaft 20, one end of spider drive shaft 20 extends through an angular detector assembly 32 that detects the angular position of spider drive shaft 20. Specifically, two disks 34 are mounted on spider drive shaft 20 in axially spaced relation within angular detector assembly 32. One disk 34 has three magnet portions which are disposed 120° offset from each other. Two proximity detectors 36 are arranged in-line, adjacent to disks 34. When a magnet portion is positioned adjacent to the respective proximity detector 36, this means that one set of guide rods 18 is positioned at 0° or top dead center (TDC) in FIG. 2. This is the position at which web matrix M is wound on a rewind core, as will be discussed in more detail hereinafter. The other disk 34 and proximity detector 36 are used for determining when to actuate a knife assembly.

A mandrel mounting block 38*a*, 38*b* or 38*c* is mounted for free sliding movement on each pair of guide rods 18, between triangular support hub 16 and the respective stop plates 14*a*–14*c*. A bumper 40 (FIG. 2) is provided to the inside of each stop plate 14*a*–14*c* to prevent damage in the event that a mounting block 38*a*–38*c* hits against the respective stop plate 14*a*–14*c*.

Figure 2:
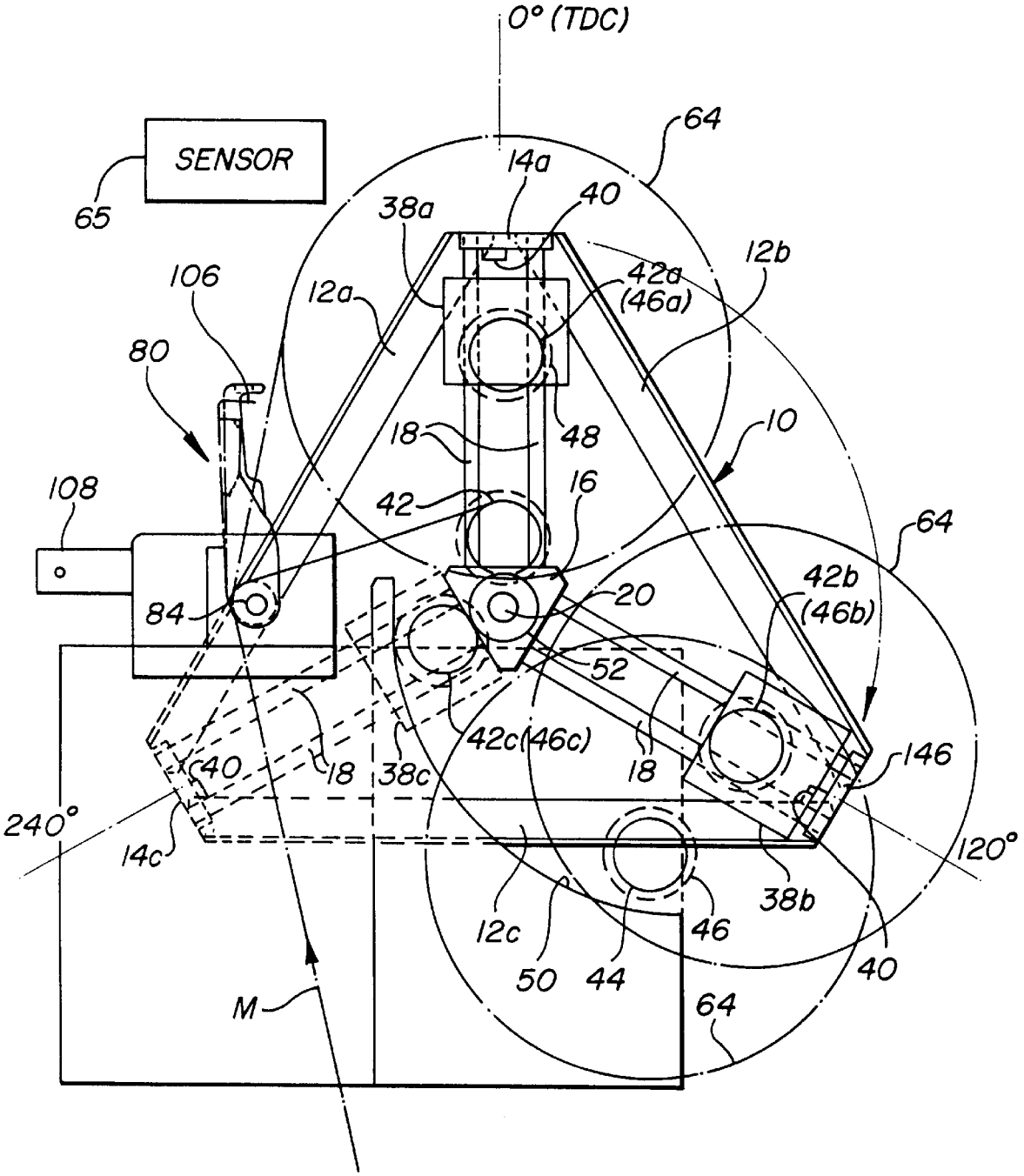
FIG. 2 is a front elevational view of the matrix rewinder.

A mandrel 42*a*, 42*b* or 42*c* is freely rotatably mounted in one direction only on a mandrel shaft 44 that is secured to the respective mandrel mounting block 38*a*, 38*b* and 38*c*, so as to extend therefrom in a cantilevered manner. A rewind core (or roll) 46*a*, 46*b* and 46*c* (FIG. 1) can be removably fixed on each mandrel 42*a*, 42*b* and 42*c* for winding web matrix M thereon. The manner of removably fixing rewind cores 46*a*–46*c* on mandrels 42*a*–42*c* is well known in the art, and is not described here. In addition, a cam follower 48 is freely rotatably mounted on each mandrel shaft 44 between the respective mandrel 42*a*–42*c* and mandrel mounting block 38, and has a larger diameter than the respective mandrel 42*a*–42*c*. As will be discussed hereinafter in greater detail, cam follower 48 rides on a cam track 50 from approximately a five o'clock position (150° clockwise from top dead center) to a nine o'clock position (270° clockwise from top dead center), as best shown in FIGS. 1 and 2. As each cam follower 48 rides on cam track 50 from approximately the five o'clock position to the nine o'clock position, the respective mandrel mounting block 38 is forced to slide radially inward along guide rods 18 toward triangular support hub 16, the purpose for which will be made apparent from the discussion hereinafter.

A mandrel drive shaft 52 is rotatably mounted on spider drive shaft 20. A pulley 54 is coaxially fixed to mandrel drive shaft 52, and another pulley 56 is fixed to an output shaft 58 of another motor 60. An endless drive belt 62 is wrapped about pulleys 54 and 56. Endless drive belt 62 is omitted from FIG. 4 for better illustration. Thus, as output shaft 58 is rotated, mandrel drive shaft 52 is caused to rotate.

In accordance with the present invention, when a surface of rewind roll (or core) 46*a*–46*c* is in contact with mandrel drive shaft 52, the rewind roll or core is caused to rotate. As shown in FIGS. 1 and 2, when rewind core 46*a* is in the top dead center position, web matrix M is wound thereon. Specifically, as shown in FIG. 1, web matrix M extends around a lower guide roller 45 with the adhesive side A out so as not to contact the same. Then, web matrix M extends around an upper guide roller 47 with the adhesive side A in contact therewith, and then onto the surface of rewind roll 46*a* at the 0° position. Adhesive side A does not stick to guide roller 47, since guide roller 47 is spirally wrapped without overlap with a sandpaper type material. Because of the small protrusions of the sandpaper type material, the adhesive does not stick thereto.

Figure 5:
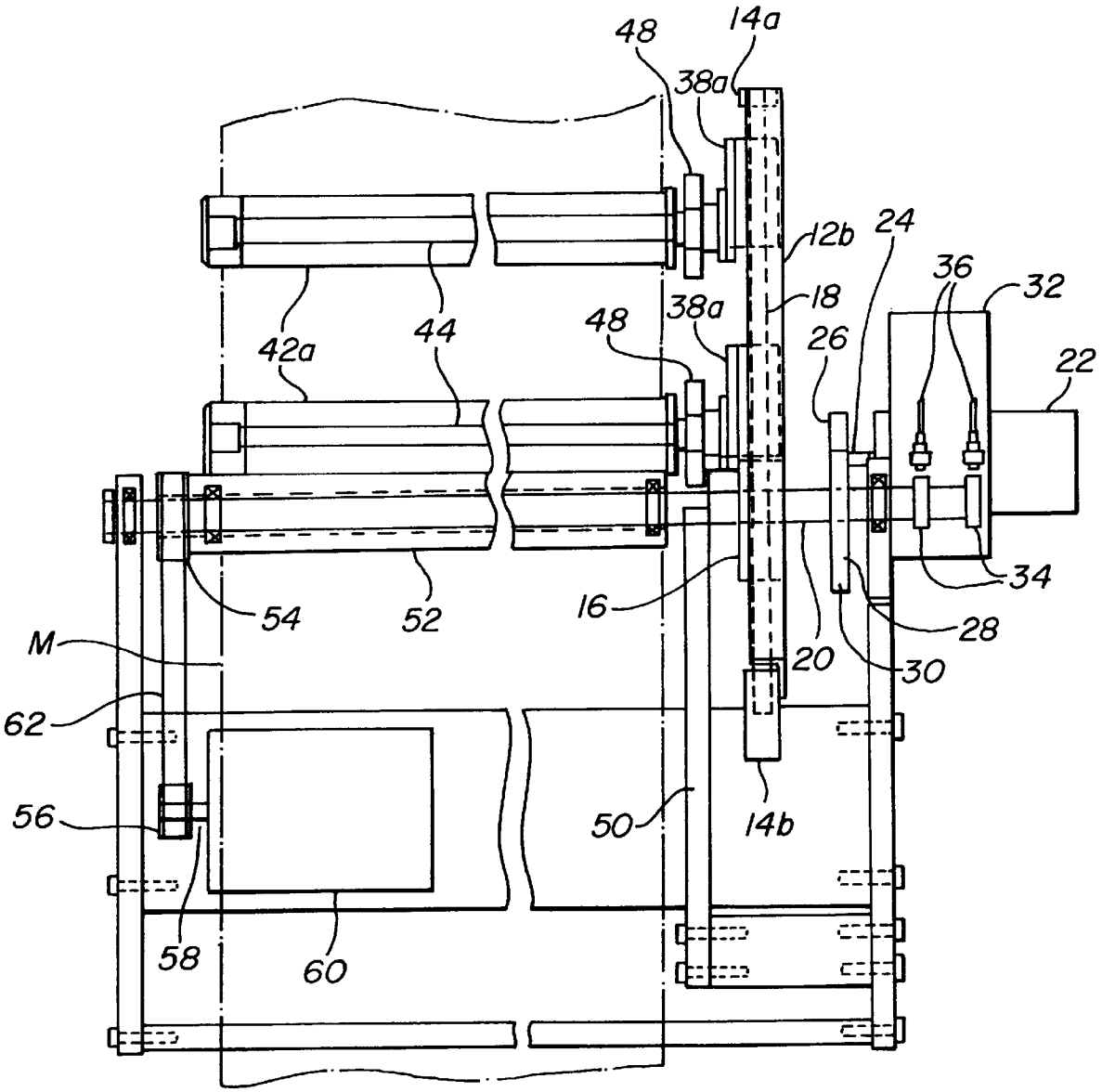
FIG. 5 is a side elevational view of the matrix rewinder.

At the start of winding, the outer diameter of rewind roll 46*a* with web matrix M thereon is small, so that rewind roll 46*a* falls radially inward, that is, falls down by gravity into driven contact with mandrel drive shaft 52. This is shown by the lower position of mandrel 42*a* at the top dead center position in FIGS. 2 and 5. As the diameter of web matrix M builds on rewind roll 46*a*, mandrel 42*a* moves upwardly along guide rods 18 to the raised position shown at the top dead center position in FIGS. 2 and 5. The maximum diameter of web matrix M thereon is shown at 64 in FIG. 2. A sensor 65 such as an electric eye or the like, senses when rewind roll 46*a* has the maximum diameter of web matrix M wound thereon.

At this time, it is necessary to remove full rewind roll 46*a* from mandrel 42*a*. In order to accomplish this, spider assembly 10 is rotated or indexed by drive motor 22. Accordingly, mandrel 42*a* at the top dead center position is moved clockwise in FIG. 2 to the position at 120°. At this position, full rewind roll 46*a* can be removed from mandrel 42*a*. Further, the core on mandrel 42*c* which had been at the 240° position is moved into contact with mandrel drive shaft 52 and rotated thereby, and then continuously moved to the top dead center position. This is due to cam follower 48 associated therewith riding along cam track 50. Once this latter mandrel 42*c* passes the 270° position, it falls down by gravity along the respective guide rods 18 so that the core thereon comes into engagement with mandrel drive shaft 52 to be driven thereby. It will be appreciated that, at this time, both the roll on mandrel 42*a* which had been at the top dead center (0°) position and the core on mandrel 42*c* which moves from the 240° position to the 0° position are still both in driven engagement with mandrel drive shaft 52.

In some instances, rewind core 46*c* moving from the 240° position may not be in driven engagement with mandrel driving roller 52. Accordingly, in order to ensure that there is driven contact, a leaf spring 66 is mounted to a frame member 68 in a cantilevered manner. When rewind core 46*c* moves to approximately the eleven o'clock position (330°), the free end of leaf spring 66 applies a slight pressure to rewind core 46*c* to ensure that it is in driven contact with mandrel driving roller 52.

Figure 3:
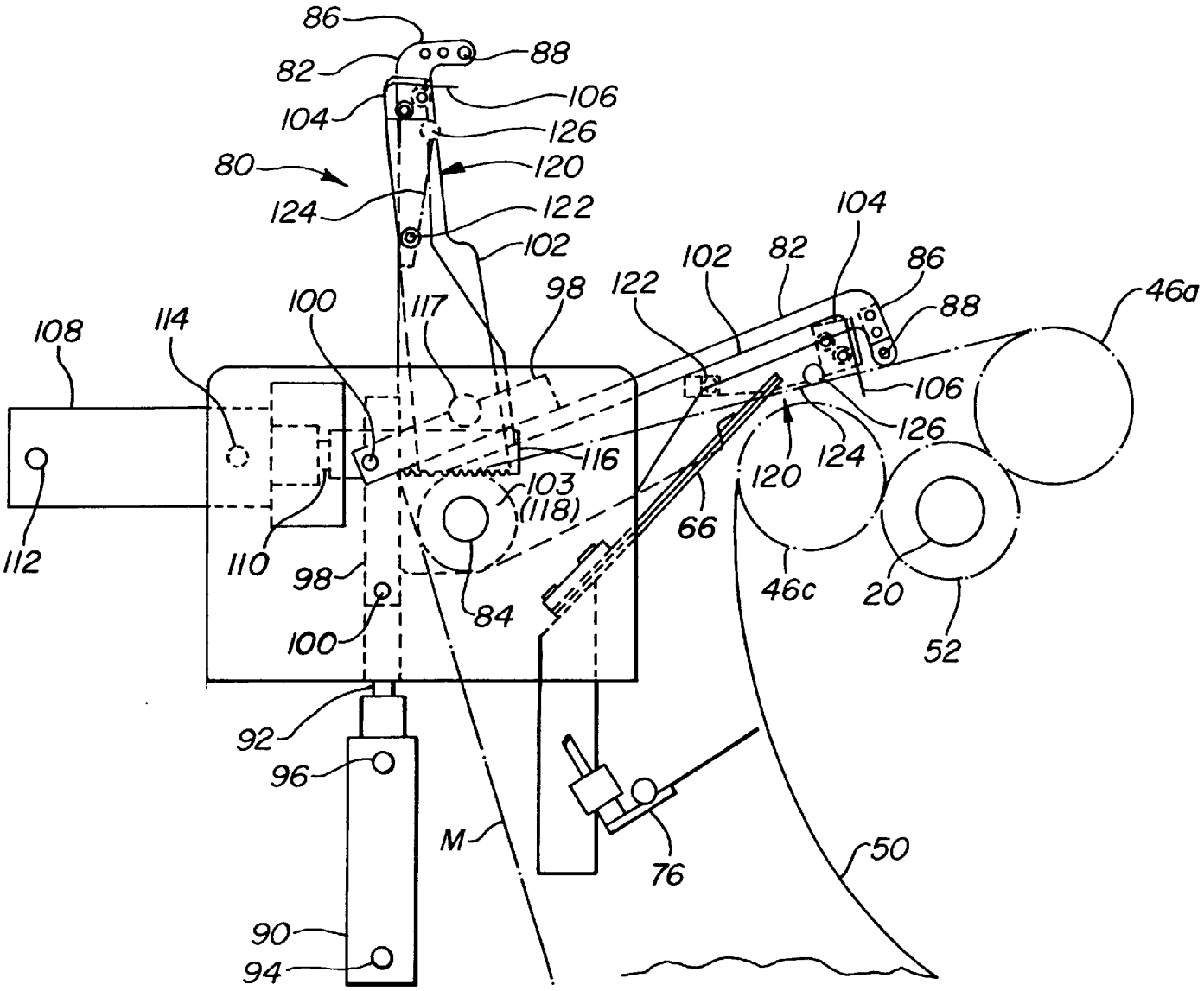
FIG. 3 is an enlarged front elevational view of a portion of the matrix rewinder.

When full rewind roll 46*a* at the 0° position is rotated to the 120° position, rewind roll 46*a* falls down by gravity so as to slide radially outwardly along the respective guide rods 18, as shown in FIG. 2, once it passes the 90° position. At such position, full rewind roll 46*a* can be removed, and a new empty rewind core can be positioned on mandrel 42*a*. In the event that full rewind roll 46*a* is not removed, this would cause a problem upon later indexing. Therefore, a proximity sensor switch 76 is provided adjacent to cam track 50 between the 120° position and the 240° position, as shown in FIG. 3. Proximity sensor switch 76 detects if there is a full or partial rewound roll 46*a*, and if yes, mandrel drive motor 52 is controlled to stop the indexing movement.

Upon upward movement of rewind core 46*c* from the 240° position to the 0° position, rewind core 46*c* contacts the adhesive side A of web matrix M. As a result, web matrix M adheres to rewind core 46*c*. Upon continued indexing of spider assembly 10, the separation between full rewind roll 46*a* and new rewind core 46*c* increases, thereby breaking web matrix M, since web matrix M easily breaks due to stretching thereof. This permits full rewind roll 46*a* to continue with its indexing operation, while new rewind core 46*c* is thereafter wound with web matrix M at the 0° position.

In many instances, it is difficult to break or tear web matrix M by stretching the same between rewind roll 46*a* and core 46*c*. Therefore, in a preferred embodiment of the present invention, a knife assembly 80 is provided to cut web matrix M extending therebetween, at the time of initial contact of rewind core 46*c* with web matrix M. Knife assembly 80 is shown both in the raised position and lowered, cutting position in FIG. 3.

Figure 4:
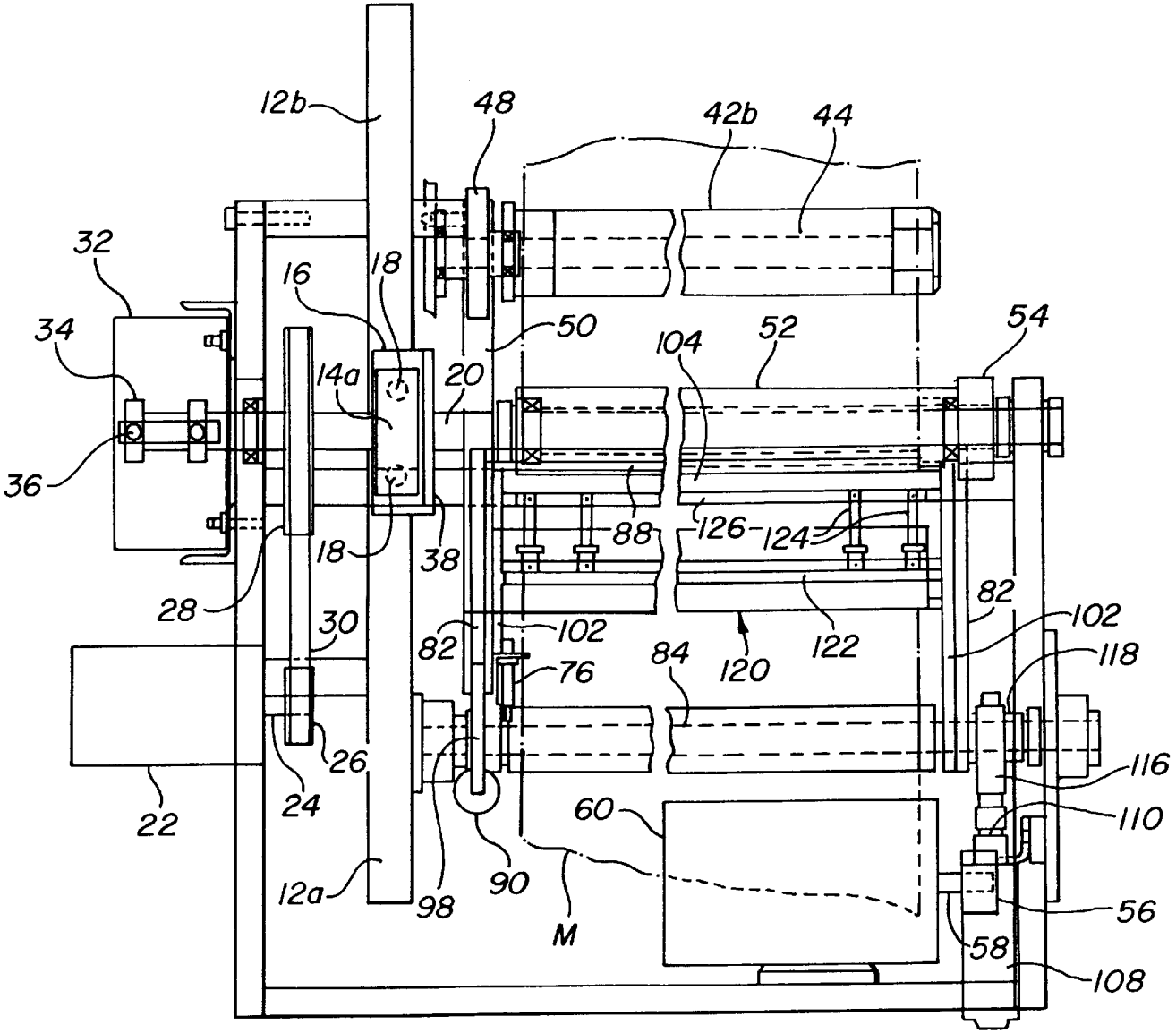
FIG. 4 is a top plan view of the matrix rewinder.

As best shown in FIGS. 3 and 4, knife assembly 80 includes two parallel, spaced apart roll arms 82 that are freely rotatably mounted on a shaft 84. Roll arms 82 each have a downturned free end portion 86, and a tie bar roll 88 extends between the free ends thereof. When roll arms 82 are moved to their lowered position, tie bar roll 88 pushes down web matrix M which extends between core 46*c* and rewind roll 46*a* in order to tension the same for cutting.

In order to actuate roll arms 82 for such pivoting movement, a cylinder 90 is mounted to a frame member (not shown) and has a retractable piston 92 which is actuated to extend or retract in dependence upon fluid supplied or removed through ports 94 and 96 of cylinder 90. Thus, when fluid is supplied to port 94, piston 92 is forced to extend, and when fluid is supplied to port 96, piston 92 is forced to retract.

A stem roll arm 98 has one end pivotally connected to the free end of piston 92 by means of a pivot pin 100. Stem roll arm 98 is fixed to the upper surface of one roll arm 82. Thus, as shown in FIG. 3, when piston 92 is extended, stem roll arm 98 is extended therewith. Because stem roll arm 98 is fixed to one roll arm 82, and because roll arms 82 are rotatably mounted on shaft 84, such extended movement, which is in the upward direction of FIG. 3, causes pivoting of roll arms 82 about shaft 84. During this time, pivot pin 100 will travel in an arcuate path between the two positions shown in FIG. 3.

Knife assembly 80 further includes two parallel, spaced apart knife arms 102 which are fixedly mounted on shaft 84. Knife arms 102 are positioned between roll arms 82, as shown in FIG. 4. A knife clamp 104 interconnects free ends of knife arms 102, and knife clamp 104 holds a knife 106 therein.

Knife arms 102 are controlled to pivot down with roll arms 82. After tie bar roll 88 presses down on web matrix M to tension the same, knife arms 102 are further rotated down such that knife 106 cuts web matrix M thereat.

In order to move knife arms 102, a cylinder 108 is mounted to a frame member and has a retractable piston 110 which is actuated to extend or retract in dependence upon fluid supplied or removed through ports 112 and 114 of cylinder 108. Thus, when fluid is supplied to port 112, piston 110 is forced to extend, and when fluid is supplied to port 114, piston 110 is forced to retract. A rack 116 is secured to piston 110 for movement therewith, and rack 116 meshes with a gear 118 fixed to shaft 84. Accordingly, when piston 110 is extended, knife arms 102 are caused to rotate in the clockwise direction of FIG. 3, and when piston 110 is retracted, knife arms 102 are caused to rotate in the counter-clockwise direction of FIG. 3. A cam roller 117 is provided to hold rack 116 in meshing engagement with gear 118.

Knife assembly 80 further includes a pressing assembly 120 for pressing the cut end of web matrix M onto rewind core 46*c*. Specifically, a cross bar 122 extends between knife arms 102. A plurality of leaf spring members 124 extend from cross bar 122 in a direction toward knife 106, but terminate before reaching knife 106. A press bar 126 is mounted to the free ends of leaf spring member 124. After knife 106 cuts web matrix M, press bar 126 presses down the cut end of web matrix M onto rewind core 46*c*.

Thereafter, pistons 92 and 110 are retracted, causing knife assembly 80 to be pivoted to its raised position away from web matrix M.

Thus, according to the present invention, web matrix M can be transferred to a new rewind core 46*c* without any down time of the machine, and without using any festoon or accumulator. Further, the full rewind roll 46*a* can be removed from the respective mandrel 46*a* at the 120° position, after transfer of web matrix M to the new rewind core 46*c* has been effected, without stopping the machine.

In addition, web matrix M is automatically cut by a knife assembly at the time of transfer to rewind core 46*c*, to ensure that such transfer is smoothly accomplished.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A matrix rewinder comprising:

a spider assembly including:

a spider drive shaft having an axis, a plurality of guides fixed with respect to said spider drive shaft and extending radially outward from said spider drive shaft, said guides being angularly spaced from each other around said spider drive shaft, a mounting block mounted on each said guide for radial movement therealong, a mandrel rotatably mounted to each said mounting block, for holding a core for receiving a web matrix having an adhesive coating thereon, and a spider drive motor for rotating said spider drive shaft so as to rotate said mandrels about the axis of said spider drive shaft;

a mandrel drive shaft mounted coaxially with said spider drive shaft and rotatable independently of said spider drive shaft;

a mandrel drive motor for rotating the mandrel drive shaft independently of said spider drive shaft such that a first core removably mounted on a first one of said mandrels in driving engagement with said mandrel drive shaft at a first position is rotated by said mandrel drive shaft so as to wind said web matrix on the first core, with said adhesive coating fixing said web matrix to said first core; and a guide assembly for guiding a second core removably mounted on a second one of said mandrels into driving engagement with said mandrel drive shaft such that said mandrel drive shaft rotates said second core in driving engagement therewith, while said first core is driven by said mandrel drive shaft and while the second core is out of engagement with said web matrix; and a sensor for sensing a diameter of said web matrix on said first core at said first position, and for supplying a signal to said spider drive motor to rotate said spider drive shaft so as to move the second core on said second mandrel into engagement with said web matrix and then to said first position in response to said sensor sensing that said web matrix wound on said first core on said first mandrel at said first position has reached a predetermined diameter, such that said web matrix extending between said first and second cores is broken and said web matrix is then wound on said second core on said second mandrel at said first position.

2. A matrix rewinder according to claim 1, wherein said spider assembly includes a central hub mounted on said spider drive shaft and said plurality of guides are secured to said central hub so as to extend radially outward of said spider drive shaft.

3. A matrix rewinder according to claim 2, wherein said guides are equiangularly spaced around said spider drive shaft.

4. A matrix rewinder according to claim 2, wherein each said guide includes a pair of parallel, spaced apart guide rods extending radially outward from said central hub.

5. A matrix rewinder according to claim 4, wherein each said mounting block is slidably mounted on said pair of guide rods for radial movement therealong.

6. A matrix rewinder according to claim 4, wherein said spider assembly further includes a stop plate secured to radial outer ends of said guide rods for limiting radial outward movement of said mounting blocks on said guide rods.

7. A matrix rewinder according to claim 1, wherein s aid guide assembly includes:

a cam track; and a cam follower rotatably mounted coaxially with each said mandrel and engaging with said cam track during a selected segment of rotation thereof about said spider drive shaft.

8. A matrix rewinder according to claim 7, wherein said first position is a top dead center position at 0°, and said selected segment of rotation occurs between approximately 150° and 270° relative to said top dead center position.

9. A matrix rewinder according to claim 1, wherein the guide assembly includes a spring element for pressing said second core on said second mandrel into driven engagement with said mandrel drive shaft at a position immediately before said second core is moved into engagement with said web matrix.

10. A matrix rewinder comprising:

a spider assembly including:

a spider drive shaft having an axis, a plurality of guides fixed with respect to said spider drive shaft and extending radially outward from said spider drive shaft, said guides being angularly spaced from each other around said spider drive shaft, a mounting block mounted on each said guide for radial movement therealong, a mandrel rotatably mounted to each said mounting block, for holding a core for receiving a web matrix having an adhesive coating thereon, and a spider drive motor for rotating said spider drive shaft so as to rotate said mandrels about the axis of said spider drive shaft;

a mandrel drive shaft mounted coaxially with said spider drive shaft and rotatable independently of said spider drive shaft;

a mandrel drive motor for rotating the mandrel drive shaft independently of said spider drive shaft such that a first core removably mounted on a first one of said mandrels in driving engagement with said mandrel drive shaft at a first position is rotated by said mandrel drive shaft so as to wind said web matrix on the first core, with said adhesive coating fixing said web matrix to said first core; and a guide assembly for guiding a second core removably mounted on a second one of said mandrels into driving engagement with said mandrel drive shaft such that said mandrel drive shaft rotates said second core in driving engagement therewith, while said first core is driven by said mandrel drive shaft and while the second core on said second mandrel is out of engagement with said web matrix;

a sensor for sensing a diameter of said web matrix on said first core at said first position, and for supplying a signal to said spider drive motor to rotate said spider drive shaft so as to move the second core on said second mandrel into engagement with said web matrix and then to said first position in response to said sensor sensing that said web matrix wound on said first core on said first mandrel at said first position has reached a predetermined diameter; and a knife assembly for cutting the web matrix extending between said first and second cores when said spider drive shaft moves said second core on said second mandrel into engagement with said web matrix and then to said first position, such that said web matrix is then wound on said second core on said second mandrel at said first position.

11. A matrix rewinder according to claim 10, wherein said spider assembly includes a central hub mounted on said spider drive shaft and said plurality of guides are secured to said central hub so as to extend radially outward of said spider drive shaft.

12. A matrix rewinder according to claim 11, wherein said guides are equiangularly spaced around said spider drive shaft.

13. A matrix rewinder according to claim 11, wherein each said guide includes a pair of parallel, spaced apart guide rods extending radially outward from said central hub.

14. A matrix rewinder according to claim 13, wherein each said mounting block is slidably mounted on said pair of guide rods for radial movement therealong.

15. A matrix rewinder according to claim 13, wherein said spider assembly further includes a stop plate secured to radial outer ends of said guide rods for limiting radial outward movement of said mounting blocks on said guide rods.

16. A matrix rewinder according to claim 10, wherein said guide assembly includes:

a cam track; and a cam follower rotatably mounted coaxially with each said mandrel and engaging with said cam track during a selected segment of rotation thereof about said spider drive shaft.

17. A matrix rewinder according to claim 16, wherein said first position is a top dead center position at 0°, and said selected segment of rotation occurs between approximately 150° and 270° relative to said top dead center position.

18. A matrix rewinder according to claim 10, wherein the guide assembly includes a spring element for pressing said second core on said second mandrel into driven engagement with said mandrel drive shaft at a position immediately before said second core is moved into engagement with said web matrix.

19. A matrix rewinder according to claim 10, wherein said knife assembly includes:

a tensioning assembly for tensioning the web matrix extending between said first and second cores; and a knife device for cutting the tensioned web matrix extending between said first and second cores.

20. A matrix rewinder according to claim 19, wherein said tensioning assembly includes:

a shaft;

a tie bar roll for pressing down the web matrix extending between said first and second cores to tension the web matrix thereat;

at least one arm mounted on said shaft for rotation about an axis of said shaft, and having said tie bar roll secured to a free end thereof; and a driving assembly for rotating said at least one arm about said axis of said shaft so as to move said tie bar roll between a first position out of engagement with said web matrix and a second position into pressing engagement with said web matrix.

21. A matrix rewinder according to claim 19, wherein said knife device includes:

a knife for cutting the web matrix;

a shaft;

at least one arm mounted on said shaft for rotation about an axis of said shaft, and having said knife secured to a free end thereof; and a driving assembly for rotating said at least one arm about said axis of said shaft so as to move said knife between a first position out of engagement with said web matrix and a second position which cuts said web matrix after said tensioning assembly tensions the web matrix extending between said first and second cores.

22. A matrix rewinder according to claim 19, wherein said knife assembly further includes a press down member for pressing down the cut web matrix onto said second core on said second mandrel.

23. A matrix rewinder according to claim 22, wherein said press down member is secured to said knife device.

* * * * *